US010815706B2

(12) United States Patent
Mittelbach

(10) Patent No.: US 10,815,706 B2
(45) Date of Patent: Oct. 27, 2020

(54) MOTOR VEHICLE DOOR LOCK AND METHOD FOR SELECTIVELY OPERATING A MOTOR VEHICLE DOOR LOCK WITH OR WITHOUT A SECURITY DEVICE

(71) Applicant: Kiekert Aktiengesellschaft, Heiligenhaus (DE)

(72) Inventor: Stephan Mittelbach, Velbert (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 1044 days.

(21) Appl. No.: 14/425,154

(22) PCT Filed: Aug. 20, 2013

(86) PCT No.: PCT/DE2013/000476
§ 371 (c)(1),
(2) Date: Apr. 13, 2015

(87) PCT Pub. No.: WO2014/032640
PCT Pub. Date: Mar. 6, 2014

(65) Prior Publication Data

US 2015/0233155 A1 Aug. 20, 2015

(30) Foreign Application Priority Data

Aug. 31, 2012 (DE) ..... 10 2012 017 286

(51) Int. Cl.
*E05B 85/20* (2014.01)
*E05B 77/28* (2014.01)
(Continued)

(52) U.S. Cl.
CPC ..... *E05B 85/20* (2013.01); *E05B 63/0056* (2013.01); *E05B 77/28* (2013.01);
(Continued)

(58) Field of Classification Search
CPC ..... E05B 77/245; E05B 77/265; E05B 77/28; E05B 77/30; E05B 81/06; E05B 81/16;
(Continued)

(56) References Cited

U.S. PATENT DOCUMENTS 4,342,209 A * 8/1982 Kleefeldt ..... E05B 77/48 292/DIG. 23
4,669,283 A * 6/1987 Ingenhoven ..... E05B 81/25 292/144
(Continued)

FOREIGN PATENT DOCUMENTS

DE 10320439 A1 11/2004
DE 202007001974 U1 6/2007
(Continued)

OTHER PUBLICATIONS

Machine Translation of DE102006017830A1 by Lexis Nexis Total Patent on Mar. 18, 2015.
(Continued)

*Primary Examiner* — Kristina R Fulton
*Assistant Examiner* — Faria F Ahmad
(74) *Attorney, Agent, or Firm* — Woodard, Emhardt, Henry, Reeves & Wagner, LLP

(57) ABSTRACT

The invention relates to a motor vehicle door lock which is equipped with a locking mechanism (1, 2) consisting of essentially a rotary latch (1) and a pawl (2), in addition to an actuating lever chain (4) and a locking unit (5, 6). Said motor vehicle door lock also comprises a security device (8, 9, 10) which can optionally set the actuating lever chain (4) and/or the locking unit (5, 6) in a non-functioning state/functioning state. According to the invention, said security device (8, 9, 10) is designed as a retrofitted module (8, 9, 10) which can be connected, according to requirements, to a base module (1-6 and 11), said module surrounding the largest part of the
(Continued)

locking mechanism (1, 2), the actuating lever chain (4) and the locking unit (5, 6).

16 Claims, 2 Drawing Sheets

(51) Int. Cl.

| | |
|---|---|
| ***E05B 81/36*** | (2014.01) |
| ***E05B 63/00*** | (2006.01) |
| ***E05B 81/16*** | (2014.01) |
| ***E05B 85/02*** | (2014.01) |
| ***E05B 77/30*** | (2014.01) |
| ***E05B 81/06*** | (2014.01) |
| ***E05B 83/36*** | (2014.01) |
| ***E05B 83/18*** | (2014.01) |
| ***E05B 77/26*** | (2014.01) |
| ***E05B 77/24*** | (2014.01) |
| ***E05B 81/54*** | (2014.01) |
| ***E05B 81/24*** | (2014.01) |

(52) U.S. Cl.
CPC ..... *E05B 81/16* (2013.01); *E05B 81/36* (2013.01); *E05B 85/02* (2013.01); *E05B 77/245* (2013.01); *E05B 77/265* (2013.01); *E05B 77/30* (2013.01); *E05B 81/06* (2013.01); *E05B 81/25* (2013.01); *E05B 81/54* (2013.01); *E05B 83/18* (2013.01); *E05B 83/36* (2013.01); *Y10S 292/23* (2013.01); *Y10S 292/53* (2013.01); *Y10S 292/54* (2013.01); *Y10S 292/64* (2013.01); *Y10T 292/108* (2015.04); *Y10T 292/1047* (2015.04); *Y10T 292/1082* (2015.04); *Y10T 292/1092* (2015.04)

(58) Field of Classification Search
CPC ..... E05B 81/25; E05B 81/54; E05B 85/02; Y10T 292/108; Y10T 292/1082; Y10T 292/1092; Y10T 292/1047; Y10S 292/23; Y10S 292/53; Y10S 292/54; Y10S 292/64
USPC ..... 292/201, 210, 216, DIG. 23, DIG. 53, 292/DIG. 54, DIG. 64
See application file for complete search history.

(56) References Cited

U.S. PATENT DOCUMENTS

| | | | | | |
|---|---|---|---|---|---|
| 4,978,154 | A * | 12/1990 | Kleefeldt | E05B 81/06 | 292/201 |
| 5,350,206 | A * | 9/1994 | Akahori | E05B 63/0056 | 292/336.3 |
| 5,802,894 | A * | 9/1998 | Jahrsetz | E05B 77/48 | 292/144 |
| 6,109,674 | A * | 8/2000 | Bartel | E05B 81/06 | 292/201 |
| 6,386,599 | B1 * | 5/2002 | Chevalier | E05B 81/14 | 292/201 |
| 6,463,773 | B1 * | 10/2002 | Dimig | E05B 83/36 | 292/201 |
| 6,575,507 | B2 * | 6/2003 | Reddmann | E05B 81/14 | 292/201 |
| 6,698,805 | B2 * | 3/2004 | Erices | E05B 77/04 | 292/201 |
| 7,232,161 | B2 * | 6/2007 | Matsuda | E05B 81/06 | 292/100 |
| 8,944,478 | B2 * | 2/2015 | Pullmann | E05B 15/022 | 292/201 |
| 9,260,882 | B2 * | 2/2016 | Krishnan | E05B 81/06 | |
| 9,574,379 | B2 * | 2/2017 | Barmscheidt | E05B 77/28 | |
| 2004/0113438 | A1 * | 6/2004 | Kachouh | E05B 81/14 | 292/201 |
| 2008/0048458 | A1 * | 2/2008 | Suzumura | E05B 79/08 | 292/216 |
| 2008/0073915 | A1 * | 3/2008 | Hunt | E05B 81/06 | 292/201 |
| 2012/0061977 | A1 * | 3/2012 | Takeda | E05B 81/20 | 292/201 |
| 2014/0203572 | A1 * | 7/2014 | Barmscheidt | E05B 77/28 | 292/200 |
| 2015/0233150 | A1 * | 8/2015 | Mittelbach | E05B 81/36 | 292/201 |
| 2015/0308163 | A1 * | 10/2015 | Tomaszewski | E05B 77/28 | 292/196 |

FOREIGN PATENT DOCUMENTS

| | | | | |
|---|---|---|---|---|
| DE | 102006017830 | A1 | 10/2007 | |
| DE | 102015002451 | A1 * | 8/2016 | E05B 63/143 |
| EP | 1350913 | A2 | 10/2003 | |
| EP | 1590547 | B1 | 7/2008 | |
| EP | 2 093 357 | A1 | 8/2009 | |
| EP | 2093357 | A1 | 8/2009 | |

OTHER PUBLICATIONS

Machine Translation of DE10320439A1 by Lexis Nexis Total Patent on Mar. 18, 2015.
Machine Translation of DE202007001974U1 by Lexis Nexis Total Patent on Mar. 18, 2015.
Machine Translation of EP1590547B1 by Lexis Nexis Total Patent on Mar. 18, 2015.

* cited by examiner

MOTOR VEHICLE DOOR LOCK AND METHOD FOR SELECTIVELY OPERATING A MOTOR VEHICLE DOOR LOCK WITH OR WITHOUT A SECURITY DEVICE

CROSS-REFERENCE TO RELATED APPLICATIONS

This application is the U.S. national stage application of International Patent Application No. PCT/DE2013/000476, filed Aug. 20, 2013, which claims priority of German Application No. 10 2012 017 286.9, filed Aug. 31, 2012, which are both hereby incorporated by reference.

BACKGROUND

The invention relates to a motor vehicle door lock which is equipped with a locking mechanism consisting of essentially a rotary latch and a pawl, in addition to an actuating lever chain and a locking unit and an optional security device selectively setting the actuating lever chain and/or the locking unit in a non-functioning state/functioning state.

A motor vehicle door lock of the above design and as disclosed in DE 20 2007 001 974 U1 is provided with a coupling element controlled by the security device or anti-theft unit. This coupling element ensures that an actuating lever, being a part of the actuating lever chain, is selectively coupled to or uncoupled from a locking unit or respective local locking element. In this way, a so-called "override" function can be simply and reliably provided.

The said "Override" function actually means that the locking unit does not first have to assume an "unlocked" position prior to actuation of the actuating lever chain in order to open the respective motor vehicle door lock. Instead, the process of unlocking and subsequent actuation or opening of the locking mechanism is basically carried out simultaneously, as described in detail in DE 103 20 439 A1. This has generally proven to be successful.

Such motor vehicle door closures or respective motor vehicle door locks do, however, require a complex design and are thus associated with not insignificant costs.

This applies in particular to the security device or anti-theft device, typically containing its own motor and at least one actuator. Said motor also produces noises during its operation that can be partly regarded as undesirable. The relative complexity of the design also increases the danger of malfunctioning, potentially making the known motor vehicle door lock more susceptible to ingress of dirt and humidity, etc.

The prior art disclosed in EP 1 590 547 B1 describes a lock of a motor vehicle door, with a selectively different design for different embodiments depending on the vehicle type. This is particularly useful in cases where one of two alternatively available embodiments is required only in low quantities compared to other embodiments. To achieve this, the alternative embodiments are provided in an unchanged same housing with drive motors of the same design and arranged in the same manner and only with different power transmitting means. The used replaceable power transmitting means is a transmission gearwheel for door opening and/or closing means and can be rotatably mounted in the housing. Although this method allows the realization of different designs, potential savings as regards arising costs are low.

The furthermore relevant prior art disclosed in DE 10 2006 017 830 A1 provides a mechanism for a motor vehicle door lock, containing at least a first and a second component carrier. The component carriers each secure at least one component from the group electric component, electromechanical component and electronic component of the motor vehicle door lock. The two component carriers can also be connected to each other. This allows a flexible use and any required upgrading, where necessary.

SUMMARY

The invention is based on the technical problem of further developing such a motor vehicle door lock in such a way that different equipment options can be made available as required at significant cost savings. Also a method for selectively operating such a motor vehicle door lock is to be provided.

In order to solve this technical problem, a generic motor vehicle door lock of the invention is characterized in that the security device is designed as a retrofitted module mainly comprising the locking mechanism, the actuating lever chain and the locking unit and which can be connected to the base module.

As part of the invention at least two modules are thus used, i.e. an obligatory base module and an optional retrofitted module, which is or is not connected to the base module, as required. The base module mainly contains the locking mechanism, the actuating lever chain and the locking unit. In contrast, the security device is designed as a retrofitted module and is consequently optional.

As a result, a motor vehicle door lock of the invention can be equipped with the security device or the retrofitted module or not, as required. The invention is based on the understanding that such security devices do not necessarily have to always be provided and in every motor vehicle or motor vehicle door lock. The security device is typically designed as an anti-theft device and generally prevents a motor vehicle door containing a respective motor vehicle door lock from being opened from the inside in an unauthorized manner after damage or destruction of a car window. This means that the security device or anti-theft device ensures in most cases that an internal door handle or generally an internal actuating element is not operational when the security device is activated or engaged. In most cases this also applies to an internal locking element.

The respective security device or anti-theft device is, however, not required in a motor vehicle with a door not containing an internal locking element or internal actuating element (for instance a tailgate). As a result of the invention, a motor vehicle with five doors can be equipped with one and the same base module. On the four side doors, the security device designed as a retrofitted module is added. In contrast, the tailgate or a boot lid only contains the base module, as in the example, the tailgate does not require an anti-theft device, thus making the security device or retrofitted module superfluous. This results in significant cost savings, as generally current motor vehicle door locks for side doors and tailgates are constructed and designed differently.

The invention thus offers the option of equipping all motor vehicle doors with the respective same base module to which, depending on the door to be equipped and its design (side door or tailgate) also the security device or the retrofitted module is added as required. This results in synergy effects and cost advantages. Customers are also given the option to individually decide about retrofitting the security device or the retrofitted module. Naturally it would also be possible not to provide individual side doors with security devices or retrofitted modules.

Alternatively, rear side doors could only be equipped with a child lock, which—when engaged—makes the anti-theft device superfluous. Flexibility is in any case increased. Such a design also offers acoustic advantages as only the motor vehicle door closures requiring the security device would be equipped with the retrofitted module. This furthermore increases operational reliability, as according to the invention, elements that are not required are also not provided. These are the main advantages of the invention.

In general, the retrofitted module contains a retrofitted module housing. As the security device normally contains a security element and a securing motor acting on the securing element, a design is in most cases chosen in which the retrofitted module housing accommodates and supports the respective securing element and securing motor.

The base module also has its own housing, the base module housing. This base module housing houses at least the locking mechanism, the actuating lever chain and the locking unit. In order to make the updating of the retrofitted module on the base module as easy as possible, the retrofitted module housing is generally designed to be insertable on the base module housing. In both cases, plastic injection moulded parts are advantageously used for the respective module housing.

In order to facilitate fitting of the retrofitted module to the base module, the retrofitted module housing and the base module housing regularly contain corresponding centering elements. These centering elements can consist of pins and/or recesses and/or projections. Individual or all centering elements can also provide locking functions where required. Generally it does, however suffice to attach the retrofitted module or retrofitted module housing to the base module or its base module housing by insertion with the aid of the centering elements.

The base module housing typically contains a base module housing hood, covering the as such open base module housing, offering overall protection against dirt and humidity. As soon as the base module housing hood is installed, the retrofitted module inserted in the base module, is further secured and fixed with the aid of the base module housing hood. As a result, the thus formed housing is best protected against dirt, humidity, etc. Depending on the requirement for the respective motor vehicle door, said housing contains the described retrofitted module or not.

The centering elements described in detail above are generally formed on the respective module housing and/or on built-in elements in or on the module housing. The module housing actually contains, for instance, a mounting structure combined with a socket, containing in this context the required centering element(s). In this context, a bearing pin for a coupling element, described in detail below, can also be used as centering element for the retrofitted module housing.

The security element generally contains at least one actuating pin. This actuating pin interacts with said coupling element when the retrofitted module is installed on the base module. The coupling element actually generally ensures, depending on the position of the security device, that the actuating lever chain is coupled to the locking unit or that both of these elements are uncoupled from each other. Coupling of the actuating lever chain to the locking unit corresponds to the position "off" of the security device. In contrast, uncoupling of the actuating lever chain from the locking unit equates to the operating position "on" of the security device.

In order to achieve these different positions on the retrofitted module installed on the base module, the actuating pin generally protrudes over the side of the retrofitted module housing. The actuating pin in turn is connected to the security element. The security element and thus also the actuating pin can be acted upon with the aid of the security motor so that the security device as a whole is able to assume the operating positions "on" and "off" described above.

In contrast to the actuating pin, the security element and the securing motor are generally covered by the securing module housing and are supported on said housing. As already explained, the security device is advantageously an anti-theft device. The invention also provides a method for selectively operating a motor vehicle door lock with or without security device, as explained in detail in claim 15.

The invention consequently provides a motor vehicle door closure and a respective operating method which allows the use of the security device or not, depending on the customer's wishes or requirements. This provides significant synergy effects as a five-door motor vehicle is, for instance as described, equipped with the base module on all five motor vehicle doors. This base module can produce the main operating states of the respective motor vehicle door of "closed", "open", "unlocked" or also "locked". Where, in addition, a safeguard such as an anti-theft device with additional operating states "anti-theft device on" or "anti-theft device off" is required, the invention offers the option to also equip the base module with a retrofitted module as required. As a result, the base module contains the security device or anti-theft device in form of the retrofitted module already described in detail. These are the main advantages of the invention.

Below, the invention is explained in more detail with reference to a drawing showing only one embodiment, in which:

DETAILED DESCRIPTION OF THE DRAWINGS

Figure 1:
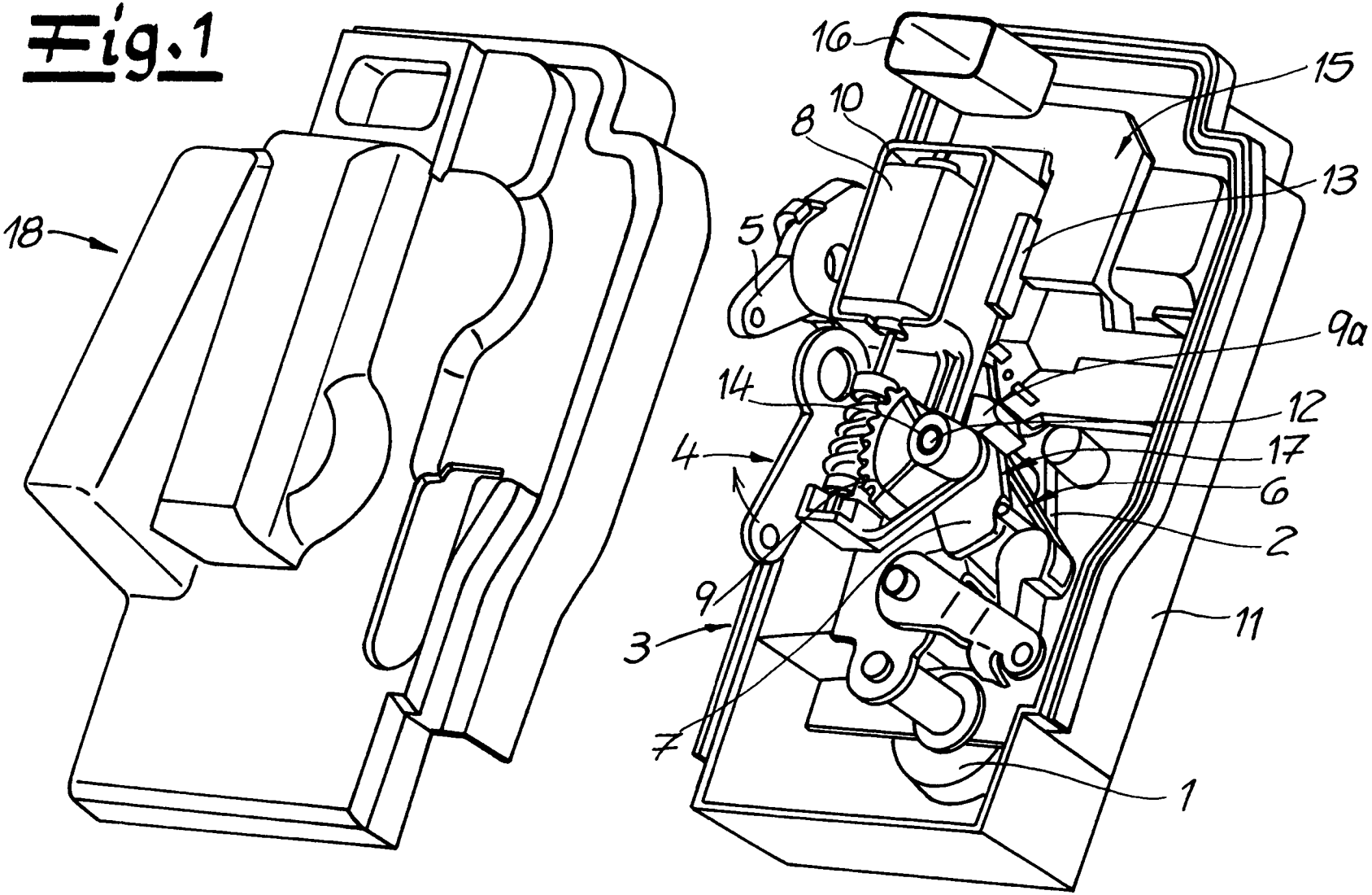
FIG. 1 shows the motor vehicle door lock of the invention with an attached retrofitted module and FIG. 2 shows an explosive view of the base module upgraded with a retrofitted module.

The figures show a motor vehicle door lock which in its basic arrangement is equipped with a locking mechanism 1, 2 consisting essentially of a rotary latch 1 and pawl 2. The locking mechanism 1, 2 interacts in the known manner with a locking bolt—not shown—on, for instance a B column of a car body. During this process, the locking bolt enters an intake slot or an infeed section 3 or can be removed again. The motor vehicle door lock shown in FIGS. 1 and 2 is installed in a respective motor vehicle door.

Figure 2:
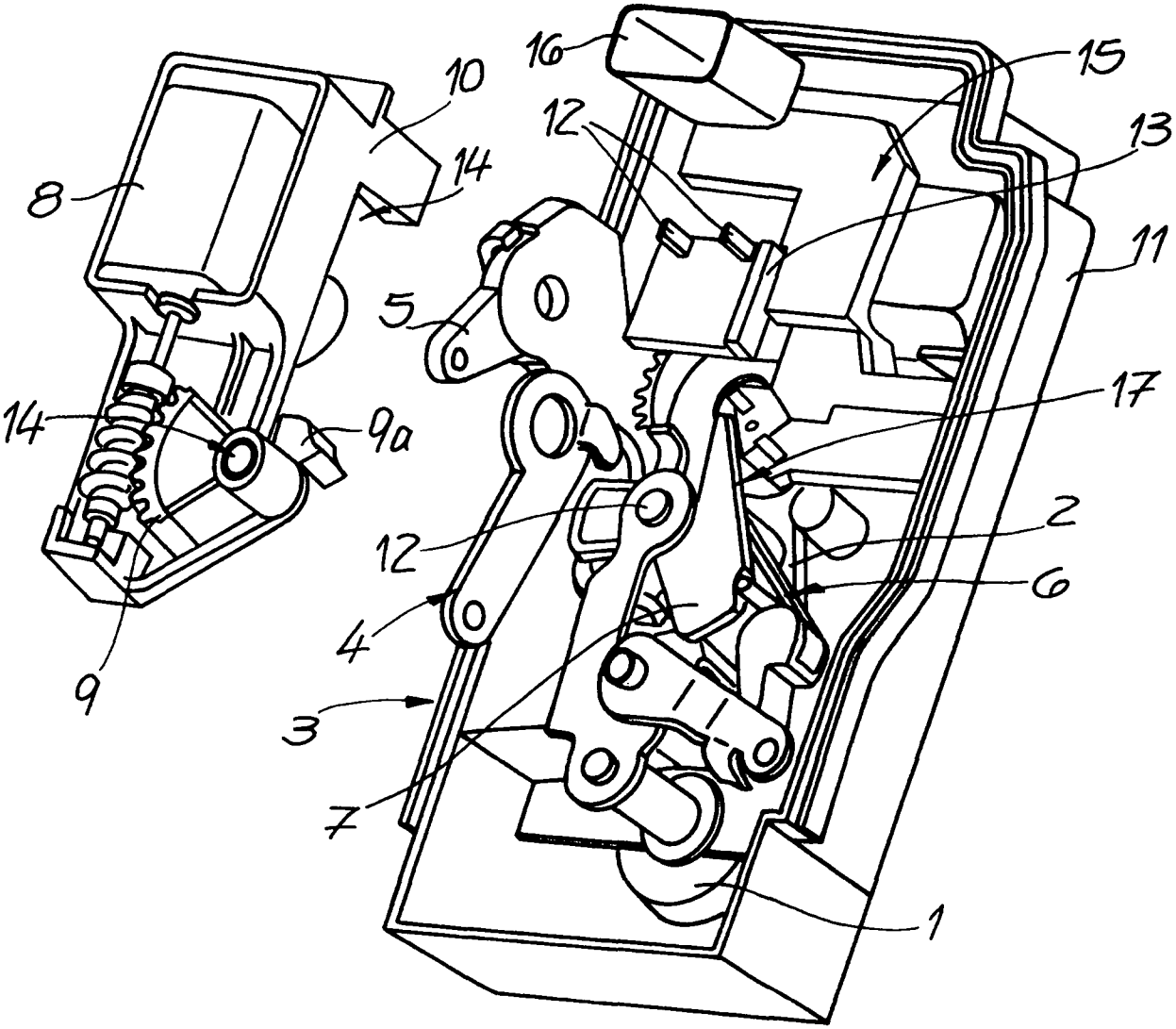

In addition to the locking mechanism 1, 2 comprising a rotary latch 1 and pawl 2, the motor vehicle door closure also contains an actuating lever chain 4 as well as a locking unit 5, 6. For reasons of clarity, only an internal actuating lever 4 is shown of the actuating lever chain 4, which can for instance be impinged on by means of an internal door handle in the manner shown in FIG. 1.

Where as a result of the impinging of the internal actuating lever 4 as shown in FIG. 1 the locking unit 5, 6 is in its operating position "unlocked", the internal actuating lever 4 ensures that the pawl 2 is lifted off the rotary latch 1. The previously retained locking bolt is released. In the embodiment of the invention the impinging of the internal actuating lever 4 causing the opening in the sense of the "override" function already described, also ensures that the locking unit 5, 6 leaves it previous "locked" position and is moved into the "unlocked" position. This implies that the internal actuating lever 4 is mechanically coupled to the locking unit 5, 6.

At this point, a coupling lever 7 or generally a coupling element 7 is provided, which depending on its position couples or uncouples the actuating lever chain or the internal actuating lever 4 with the locking unit 5, 6. In the mechanically coupled operating position of the internal actuating lever or of the actuating lever chain 4 with the locking unit 5, 6 the actuating lever chain 4 is able to move the locking unit from its "locked" position to its "unlocked" position and to simultaneously open the locking mechanism 1, 2 as described. In contrast, the mechanically uncoupled operating position of the actuating lever chain 4 from the locking unit 5, 6 causes respective actuations of the internal door handle and thus of the internal actuating lever or of the actuating lever chain 4 not to have any effect in this context.

The coupling element 7 consequently essentially assumes two operating positions with the coupling element 7 interacting for this purpose with a security device 8, 9, 10 described in more detail below. On one hand the security device 8, 9, 10 actually steers the coupling element 7 into the position coupling the actuating lever chain 4 and the locking unit 5, 6. The operating position "off" of the security device 8, 9, 10 corresponds with this position. In contrast, the position of the coupling element 7, in which the actuating lever chain 4 and the locking unit 5, 6 are mechanically uncoupled, corresponds with the operating position "off" of the security device 8, 9, 10. The security device 8, 9, 10 is able, to render the actuating lever chain 4 and the locking unit 5, 6 non-functioning/functioning.

Generally, the security device 8, 9, 10 can, however, also be designed in such a way that the actuating lever chain 4 or the locking unit 5, 6 can be selectively set to non-functioning/functioning. In the embodiment the security device 8, 9, 10 does however ensure that the actuating lever chain 4 and the locking unit 5, 6 are either both non-functioning or functioning.

When comparing FIGS. 1 and 2 it is apparent that the security device 8, 9, 10 is optionally designed as a retrofitted module 8, 9, 10 connectable to the base module 1 to 6 and 11. Actually, the base module 1 to 6 and 11 a least contains the aforementioned locking mechanism 1, 2, the actuating lever chain 4 and the locking unit 5, 6. In contrast, the retrofitted module 8, 9, 10 is the security device 8, 9, 10, already described and which in the shown example is designed as an anti-theft device 8, 9, 10 although the invention is not limited to this.

The retrofitted module 8, 9, 10 contains a retrofitted module housing 10. The retrofitted module 8, 9, 10 also contains a security device 8, 9, 10, a security element 9 and a securing motor 8 impinging the security element 9. The security element 9 is a circular disk segment that can be pivoted in clockwise or counter-clockwise direction with the aid of a worm gear attached to a drive shaft of the securing motor 8. It is also apparent that an actuating pin 9*a* is provided, which is connected to the securing device 9.

The base module 1 to 6 and 11 also has its own housing, the base module housing 11. This base module housing 11 accommodates at least the locking mechanism 1, 2, the actuating lever chain 4 and the locking unit 5, 6. The retrofitted module housing 10 and the base module housing 11 are in this case injection-moulded plastic parts. The retrofitted module 8, 9, 10 can also be attached to the base module 1 to 6 and 11. For this purpose, the retrofitted module housing 10 is designed to be attachable to the base module housing 11.

It is apparent that the retrofitted module housing 10 and the base module housing 11 contain corresponding centering elements 12, 13, 14. In the shown example the centering elements 12, 13, 14 consist of pins 12, a recess 14 and a projection 13. The centering elements 12, 13, 14 are formed on the respective module housing 10, 11 or on the built-in elements on the module housing 10, 11.

It is indeed apparent that in the shown example the retrofitted module housing 10 contains a recess 14. In contrast, the pins 12 are positioned on a mounting structure 15 for the base module housing 11, also containing a socket 16. Finally, a further pin 12 is provided in form of a rotary axis accommodating the coupling element 7. This pin 12 interacts with a respective circular recess 14 on or in the retrofitted module housing 10. The projection 13 is finally located on said mounting structure 15.

As soon as the retrofitted module 8, 9, 10 or the security device 8, 9, 10 is joined to the base module 1 to 6 and 11 i.e. in the assembled state of the retrofitted module 8, 9, 10, the actuating pin 9*a* interacts with said coupling element 7. For this purpose, the coupling element 7 contains an edge 17 apparent from FIG. 2 for the engaging actuating pin 9*a*. As a result, the security device or the retrofit element 8, 9, 10 is able to move the coupling element 7 as described in relation to its axis of rotation or the pin 12 into a position coupling the actuating lever chain 4 and the locking unit 5, 6 and into a position uncoupling these two elements 4 and 5, 6. The first operating position corresponds with the security device 8, 9, and 10 being in its "off" position. The latter operating position corresponds, on the other hand to the security device 8, 9, and 10 being in the "on" position.

From FIG. 2 it is apparent that security element 9 and the securing motor 8 are covered by the security model housing 10 and are supported by said housing. In contrast, the actuating pin 9*a* laterally protrudes or laterally exceeds the retrofitted module housing 10. This is necessary for the actuating pin 9*a* to be able to interact with the coupling element 7 as described when the retrofitted module 8, 9, 10 is fixed to the base module 1 to 6 and 11.

As described, the base module 1 to 6 and 11 can selectively contain a retrofitted module 8, 9, 10 or not. As soon as the base module 1 to 6 and 11 is equipped with the retrofitted module 8, 9, 10, the thus provided motor vehicle door closure contains the described anti-theft function. Without retrofitted module 8, 9, 10 no anti-theft device is provided and this may have to be achieved in a different manner. Typically, tailgates of motor vehicles do not require such an anti-theft function, so that for such motor vehicle closures the retrofitted module 8, 9, 10 is not required.

In all cases, the base module housing 11 is enclosed with the aid of a basic module housing cover 18. The base module housing cover 18 also ensures that the retrofitted module 8, 9, 10 attached to the base module 1 to 6 and 11 is maintained in the attached position.

The invention claimed is:

1. A motor vehicle door lock comprising:

a locking mechanism comprising a rotary latch and pawl, an actuating lever chain, a locking unit, a base module which surrounds the largest part of the locking mechanism, the actuating lever chain and the locking unit;

an optional security device that comprises an actuating pin that interacts with a coupling element of the actuating lever chain in its installed state, wherein the optional security device is designed as an anti-theft device, wherein the optional security device selectively sets the actuating lever chain and/or the locking unit in a non-functioning/functioning state, wherein, depending on the position of the optional security device, the coupling element couples or uncouples the actuating lever chain and the locking unit, wherein the optional security device is a retrofitted module adapted to be selectively connected to the locking mechanism, and wherein the optional security device contains a securing element, a security motor impinging on the security element, wherein the security element and the security motor are covered and supported by the security module housing and wherein the security element is a circular disk segment that can be pivoted by a worm gear coupled to the security motor.

2. The motor vehicle door lock according to claim 1, wherein the retrofitted module contains a retrofitted module housing.

3. The motor vehicle door lock according to claim 2, wherein the base module contains a base module housing accommodating at least the locking mechanism, the actuating lever chain and the locking unit.

4. The motor vehicle door lock according to claim 2, wherein the retrofitted module housing is adapted to be selectively attached to the base module housing.

5. The motor vehicle door lock according to claim 2, wherein the retrofitted module housing and the base module housing are each injection moulded plastic parts.

6. The motor vehicle door lock according to claim 3, wherein the retrofitted module housing and the base module housing are equipped with corresponding centering elements.

7. The motor vehicle door lock according to claim 6, wherein the centering elements are designed as pins and/or recesses and/or projections.

8. The motor vehicle door lock according to claim 6, wherein the centering elements are formed on the respective module housing and/or on built-in elements in or on the module housing.

9. The motor vehicle door lock according to claim 1, wherein the actuating pin laterally protrudes the retrofitted module housing.

10. The motor vehicle door lock according to claim 1, wherein the base module contains a base module housing accommodating at least the locking mechanism, the actuating lever chain and the locking unit.

11. The motor vehicle door lock according to claim 3, wherein the retrofitted module housing is adapted to be selectively attached to the base module housing.

12. The motor vehicle door lock according to claim 4, wherein the retrofitted module housing and the base module housing are each injection moulded plastic parts.

13. The motor vehicle door lock according to 7, wherein the centering elements are formed on the respective module housing and/or on built-in elements in or on the module housing.

14. The motor vehicle door lock according to claim 1, further comprising a module housing cover removably couplable to the base module to cover the locking mechanism and the retrofitted module.

15. The motor vehicle door lock according to claim 14, wherein the module housing cover maintains the retrofitted module in an attached position when the module housing cover is attached to the base module.

16. The motor vehicle door lock according to claim 6, wherein one of the centering elements is aligned with an access of rotation of the actuating pin on the security element which interacts with the coupling element on the locking mechanism when the security element is installed on the locking mechanism.

* * * * *